US011293079B2

(12) United States Patent
Kubushiro et al.

(10) Patent No.: US 11,293,079 B2
(45) Date of Patent: Apr. 5, 2022

(54) TIAL ALLOY MEMBER, METHOD OF MANUFACTURING THE SAME, AND METHOD OF FORGING TIAL ALLOY MEMBER

(71) Applicant: IHI Corporation, Koto-ku (JP)

(72) Inventors: Keiji Kubushiro, Tokyo (JP); Masanobu Baba, Tokyo (JP); Yohei Sakakibara, Tokyo (JP); Yutaro Ota, Tokyo (JP)

(73) Assignee: IHI Corporation, Koto-ku (JP)

( * ) Notice: Subject to any disclaimer, the term of this patent is extended or adjusted under 35 U.S.C. 154(b) by 0 days.

(21) Appl. No.: 16/903,441

(22) Filed: Jun. 17, 2020

(65) Prior Publication Data

US 2020/0362439 A1 Nov. 19, 2020

Related U.S. Application Data

(63) Continuation of application No. PCT/JP2018/023826, filed on Jun. 22, 2018.

(30) Foreign Application Priority Data

Dec. 19, 2017 (JP) ..... JP2017-242371

(51) Int. Cl.
*C22C 14/00* (2006.01)
*B21J 5/00* (2006.01)
*C23C 2/12* (2006.01)

(52) U.S. Cl.
CPC ..... *C22C 14/00* (2013.01); *B21J 5/00* (2013.01); *C23C 2/12* (2013.01)

(58) Field of Classification Search
CPC ..... C22C 14/00; B21J 5/00; C23C 2/12
See application file for complete search history.

(56) References Cited

U.S. PATENT DOCUMENTS 5,372,663 A * 12/1994 Shibue ..... B22F 3/12 148/669
5,897,830 A * 4/1999 Abkowitz ..... C22C 1/1036 420/417
7,115,177 B2 10/2006 Appel et al.
9,120,151 B2 9/2015 Godfrey et al.
2002/0157740 A1 10/2002 Appel et al.
(Continued)

FOREIGN PATENT DOCUMENTS

CN 1639380 A 7/2005
CN 101748358 A 6/2010
(Continued)

OTHER PUBLICATIONS

Xiang et al. ("Pack deposition of coherent aluminide coatings on γ-TiAl for enhancing its high temperature oxidation resistance." Surface and coatings Technology 161.2-3 (2002): 286-292.) (Year: 2002).*

(Continued)

*Primary Examiner* — Sally A Merkling
*Assistant Examiner* — Ricardo D Morales
(74) *Attorney, Agent, or Firm* — Oblon, McClelland, Maier & Neustadt, L.L.P.

(57) ABSTRACT

A TiAl alloy member for hot forging includes a substrate made of TiAl alloy, and an Al layer formed on a surface of the substrate, the Al layer containing Al as a main constituent and containing Ti.

4 Claims, 8 Drawing Sheets

(56) References Cited

U.S. PATENT DOCUMENTS

| | | | | |
|---|---|---|---|---|
| 2004/0045644 | A1 | 3/2004 | Guther et al. | |
| 2005/0244668 | A1* | 11/2005 | Narita | C22C 14/00 428/610 |

FOREIGN PATENT DOCUMENTS

| | | | |
|---|---|---|---|
| EP | 1 493 834 | A1 | 1/2005 |
| JP | 05-039872 | A | 2/1993 |
| JP | 05-043958 | A | 2/1993 |
| JP | 10-156554 | A | 6/1998 |
| JP | 2001-271165 | A | 10/2001 |
| JP | 2003-277858 | A | 10/2003 |
| JP | 2008-229680 | A | 10/2008 |
| JP | WO 2011/118663 | A1 | 9/2011 |
| RU | 2 222 635 | C2 | 1/2004 |
| WO | WO 2016/063839 | A1 | 4/2016 |

OTHER PUBLICATIONS

International Search Report dated Sep. 11, 2018 in PCT/JP2018/023826 filed on Jun. 22, 2018, 2 pages.

Janschek, "Wrought TiAl blades", Materials Today: Proceedings 2S, 2015, pp. S92-S97.

Pflumm et al., "Oxidation protection of γ-TiAl-based alloys—A review", Intermetallics, vol. 56, 2015, pp. 1-14.

Russian Office Action dated Oct. 30, 2020 in Russian Patent Application No. 2020123243/05(040092) (with English language translation), 20 pages.

Japanese Office Action dated Sep. 7, 2021 in Japanese Patent Application No. 2019-569021, 4 pages.

Combined Chinese Office Action and Search Report dated Oct. 11, 2021 in Chinese Patent Application No. 201880081379.X (with English translation of Categories of Cited Documents), 9 pages.

Extended European Search Report dated Jul. 29, 2021 in European Patent Application No. 18891162.2, 8 pages.

J. Grüters, et al. "Influence of Thermodynamic Activities of Different Masteralloys in Pack Powder Mixtures to Produce Low Activity Aluminide Coatings on TiA1 Alloys" Intermetallics, XP029203655, vol. 60, Feb. 2, 2015, pp. 19-27.

Office Action as received to the corresponding CA patent application No. 3,086,164 dated Dec. 22, 2021, 3 pages).

Chungen Zhou, et al., "A study on aluminide and Cr-modified aluminide coatings on TiA1 alloys by pack cementation method", Surface and Coatings Technology 132 (2000) 117-123.

C.H. Koo, et al., "Pack cementation coatings on $Ti_3A1$-Nb alloys to modify the high-temperature oxidation properties", Surface and Coatings Technology 126 (2000) 171-180.

* cited by examiner

UPPER DIE SIDE

LOWER DIE SIDE

TIAL ALLOY MEMBER, METHOD OF MANUFACTURING THE SAME, AND METHOD OF FORGING TIAL ALLOY MEMBER

CROSS REFERENCE TO RELATED APPLICATIONS

This application is a continuation application of International Application No. PCT/JP2018/023826, filed on Jun. 22, 2018, which claims priority to Japanese Patent Application No. 2017-242371, filed on Dec. 19, 2017, the entire contents of which are incorporated by references herein.

BACKGROUND

1. Field

The present disclosure relates to a TiAl alloy member, a method of manufacturing the same, and a method of forging a TiAl alloy member and particularly relates to a TiAl alloy member for hot forging, a method of manufacturing the same, and a method of forging a TiAl alloy member.

2. Description of the Related Art

A TiAl (titanium aluminide) alloy is an alloy made of an intermetallic compound of Ti (titanium) and Al (aluminum). The TiAl alloy has excellent heat resistance, and has lighter weight and has higher specific strength than Ni-based alloys. Accordingly, the TiAl alloy is applied to aircraft engine parts such as turbine blades and the like. Since the TiAl alloy has poor ductility and is a material difficult to process, in the case of hot-forging the TiAl alloy, isothermal forging is performed. Moreover, in order to prevent oxidation of the TiAl alloy, the hot forging is performed with the TiAl alloy covered with a sheath made of Ti, a Ti alloy, or the like having similar deformation resistance to the deformation resistance of the TiAl alloy. See Japanese Patent Application Publication No. 2008-229680 (Patent Literature 1).

SUMMARY

When the TiAl alloy is oxidized, an oxygen enriched layer called α-case is formed on a surface. The α-case is a material difficult to process which has higher hardness than the base material and has poor ductility. Accordingly, when the α-case is formed on the surface of the TiAl alloy, forging crack may occur in the hot forging. When the TiAl alloy is hot-forged in the air atmosphere while being covered with the sheath to prevent oxidation of the TiAl alloy and suppress the formation of α-case, difficult welding work of Ti, the Ti alloy, or the like needs to be performed in the covering with the sheath. Moreover, in some cases, the sheath firmly adheres to the TiAl alloy after the hot forging and removable work of the sheath is difficult. As described above, when the TiAl alloy is hot-forged while being covered with the sheath, there is a possibility that the work in the hot forging is complicated and workability decreases.

Accordingly, an object of the present disclosure is to provide a TiAl alloy member, a method of manufacturing the same and a method of forging a TiAl alloy member which can improve workability in hot forging.

A TiAl alloy member according to the present disclosure is a TiAl alloy member for hot forging, including a substrate made of a TiAl alloy, and an Al layer formed on a surface of the substrate, the Al layer containing Al as a main constituent and containing Ti.

The TiAl alloy member according to the present disclosure may include an alumina film provided on a surface of the Al layer and made of alumina.

In the TiAl alloy member according to the present disclosure, a thickness of the Al layer may be 10 μm or more and 100 μm or less.

In the TiAl alloy member according to the present disclosure, the TiAl alloy may contain 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities.

A method of manufacturing a TiAl alloy member according to the present disclosure is a method of manufacturing a TiAl alloy member for hot forging, including a substrate formation step of forming a substrate by melting and casting a TiAl alloy raw material, and an Al layer formation step of forming an Al layer, containing Al as a main constituent and containing Ti, on a surface of the substrate by diffusion coating the substrate with Al.

In the method of manufacturing a TiAl alloy member according to the present disclosure, in the Al layer formation step, the substrate may be buried in a processing powder obtained by mixing an Al raw material powder, an activator, and a sintering inhibitor and be subjected to thermal treatment in a non-oxidizing atmosphere at 650° C. or higher and 800° C. or lower.

In the method of manufacturing a TiAl alloy member according to the present disclosure, the TiAl alloy raw material may contain 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities.

A method of forging a TiAl alloy member according to the present disclosure is a method of forging a TiAl alloy member for hot forging, including an Al layer formation step of forming an Al layer, containing Al as a main constituent and containing Ti, on a surface of a substrate made of TiAl by diffusion coating the substrate with Al, and a hot forging step of hot-forging the substrate on which the Al layer is formed in an air atmosphere.

In the method of forging a TiAl alloy member according to the present disclosure, in the Al layer formation step, the substrate may be buried in a processing powder obtained by mixing an Al raw material powder, an activator, and a sintering inhibitor and be subjected to thermal treatment in a non-oxidizing atmosphere at 650° C. or higher and 800° C. or lower.

In the method of forging a TiAl alloy member according to the present disclosure, the TiAl alloy may contain 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities.

Since the aforementioned configuration can more easily prevent formation of α-case in hot forging in an air atmosphere and suppress forging crack, the workability in hot forging can be improved.

DESCRIPTION OF EMBODIMENTS

Figure 1:
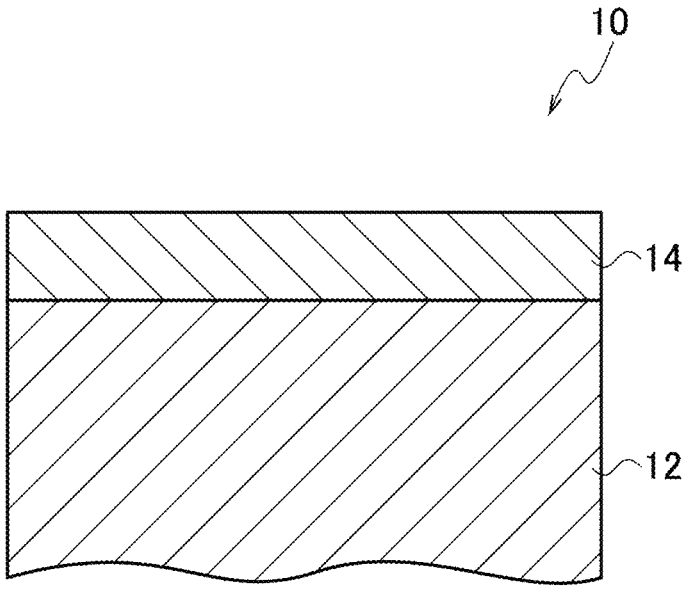
FIG. 1 is a cross-sectional view illustrating a configuration of a TiAl alloy member for hot forging in an embodiment of the present disclosure.

An embodiment of the present disclosure is described below in detail by using the drawings. FIG. 1 is a cross-sectional view illustrating a configuration of a TiAl alloy member 10 for hot forging. The TiAl alloy member 10 for hot forging includes a substrate 12 made of a TiAl alloy and an Al layer 14 formed on a surface of the substrate 12.

The substrate 12 is made of the TiAl alloy. The TiAl alloy may have TiAl ($\gamma$ phase), $Ti_3Al$ ($\alpha_2$ phase), or the like which are intermetallic compounds of Ti (titanium) and Al (aluminum). The alloy composition of the TiAl alloy may consist only of Ti and Al while containing no other alloy constituents. The alloy composition of the TiAl alloy may contain Ti, Al, and other alloy constituents. The other alloy constituents can be at least one element selected from, for example, Nb (niobium), V (vanadium), Mo (molybdenum), Ta (tantalum), Cr (chromium), Mn (manganese), Ni (nickel), Si (silicon), B (boron), Cu (copper), Fe (iron), and the like.

A TiAl alloy which has low deformation resistance at high temperature and which can be subjected to high-speed forging at high strain rate may be used as the TiAl alloy. A TiAl alloy containing 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities (hereafter, this TiAl alloy is sometimes referred to as high-speed forging TiAl alloy) can be used as the TiAl alloy which can be subjected to high-speed forging as described above. The high-speed forging TiAl alloy has a metallographic structure in which a crystal grain size is 200 μm or less, and borides (TiB, $TiB_2$, or the like) with a particle size of 100 μm or less are contained. Accordingly, the ductility is great and the hot forging properties can be improved. Since the high-speed forging TiAl alloy has excellent high temperature deformation properties in hot forging, the high-speed forging TiAl alloy can be subjected to high-speed forging at a strain rate of 1/second or higher or at a strain rate of 10/second or higher.

The Al layer 14 may be formed on the surface of the substrate 12, contains Al as the main constituent, and contains Ti. In this case, the main constituent of the Al layer 14 is a constituent contained in the greatest amount in the Al layer 14 among the constituents contained in the Al layer 14. Since the main constituent of the Al layer 14 is Al, in hot forging in an air atmosphere which is an oxidizing atmosphere, an alumina film with excellent oxidation resistance is formed on a surface of the Al layer 14. This can suppress formation of $\alpha$-case in the TiAl alloy out of which the substrate 12 is made.

Specifically, when the $\alpha$-case is formed on the TiAl alloy, forging crack is likely to occur in the hot forging in the air atmosphere because the $\alpha$-case is brittle. Moreover, when the $\alpha$-case is formed on the high-speed forging TiAl alloy, since forging crack is likely to occur in the hot forging, it is difficult to process the high-speed forging TiAl alloy at a high strain rate. Meanwhile, when the Al layer 14 is formed on the surface of the substrate 12, the alumina film is formed on the surface of the Al layer 14 by selective oxidation. Thus, permeation of oxygen is suppressed and the formation of $\alpha$-case is suppressed. The forging crack can be thereby prevented from occurring in the hot forging. Moreover, since the forging crack in the hot forging can be suppressed also in the high-speed forging TiAl alloy, high-speed forging at a higher strain rate can be performed.

The alumina film formed by selective oxidation of the Al layer 14 forms a fine protection oxide film and has excellent adherence. Even if the alumina film peels off in the hot forging, a portion of the Al layer 14 where the alumina film has peeled off is immediately selectively oxidized and a new alumina film is formed. For example, a ceramic film formed by applying and firing ceramic coating is a porous film. Accordingly, oxygen permeates through this ceramic film and the $\alpha$-case is likely to be formed. Moreover, a ceramic film formed by physical vapor deposition (for example, a sputtering method, an ion plating method, a vacuum deposition method, or the like) has thin film thickness. Accordingly, this ceramic film is highly permeable to oxygen and is likely to peel off and the $\alpha$-case is likely to be formed. As described above, coating the surface of the substrate 12 with the Al layer 14 forms the alumina film which serves as the excellent protection oxide film in the hot forging in the air atmosphere, and the Al layer 14 can thus suppress the $\alpha$-case at a higher level than the ceramic films formed by other coating methods.

The Al layer 14 may be formed to contain Ti. Forming the Al layer 14 to contain Ti can improve adherence between the substrate 12 and the Al layer 14. Ti contained in the Al layer 14 may be Ti diffused out from the substrate 12. Forming the Al layer 14 as a diffusion layer containing Ti diffused out from the substrate 12 can further improve the adherence between the substrate 12 and the Al layer 14.

The Al layer 14 may be formed to have a higher Al concentration than the substrate 12. The Al concentration of the Al layer 14 can be 60 at % or more, may be 70 at % or more, and may be 80 at % or more or 90 at % or more. The Al concentration of the Al layer 14 can be, for example, a value measured by energy dispersive X-ray analysis (EDX) or the like. The Ti concentration of the Al layer 14 may be constant in the thickness direction of the Al layer 14 or there may be a concentration gradient. For example, the Al layer 14 may be formed to have such a gradient that the Ti concentration increases from the surface side of the Al layer 14 toward the substrate side in the thickness direction of the Al layer 14.

The Al layer 14 may be made of $TiAl_2$, $TiAl_3$, or the like which are intermetallic compounds richer in aluminum than TiAl ($\gamma$ phase) and $Ti_3Al$ ($\alpha_2$ phase). The Al layer 14 may be made only of $TiAl_2$ or only of $TiAl_3$. Alternatively, the Al layer 14 may be made of both of $TiAl_2$ and $TiAl_3$. Specifically, the Al layer 14 may be formed of a mixed layer obtained by mixing $TiAl_2$ and $TiAl_3$ or of two layers of a $TiAl_2$ layer and a $TiAl_3$ layer.

The Al layer 14 may contain Al, Ti, and other constituents. The Al layer 14 may contain at least one constituent selected from Nb, V, Mo, Ta, Cr, Mn, Ni, Si, B, Cu, Fe, and the like as the other constituents. For example, when the Al layer 14 contains Cr or Si with excellent oxidation resistance, the oxidation resistance can be improved. For example, these other constituents may be contained in the Al layer 14 by being diffused out from the substrate 12 to the Al layer 14. When the substrate 12 is made of the high-speed forging TiAl alloy, the Al layer 14 may be formed of a diffusion layer containing Ti diffused out from the substrate 12 and also containing at least one of constituents of Nb, V, and B diffused out from the substrate 12.

The thickness of the Al layer 14 can be 10 μm or more and 100 μm or less. When the thickness of the Al layer 14 is less than 10 μm, the thickness of the alumina film formed by selective oxidation is also thin and the oxygen is likely to permeate through the alumina film. When the thickness of the Al layer 14 is more than 100 μm, the Al layer 14 is likely to peel off.

The thickness of the Al layer 14 may be 10 μm or more and 30 μm or less. The thickness of the Al layer 14 is 30 μm or less because the Al layer 14 is removed by machining or the like after the hot forging and thus only needs to prevent oxidation and suppress the formation of $\alpha$-case during the hot forging. Moreover, reducing the thickness of the Al layer 14 can reduce thermal treatment time in diffusion coating to be described later.

(Method of Manufacturing TiAl Alloy Member 10 for Hot Forging)

Figure 2:
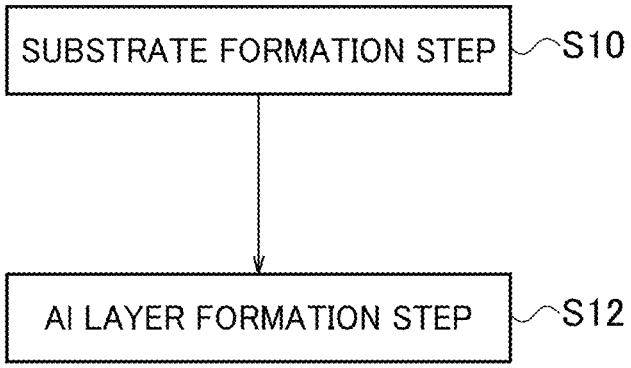
FIG. 2 is a flowchart illustrating a configuration of a method of manufacturing the TiAl alloy member for hot forging in the embodiment of the present disclosure.

Next, a method of manufacturing the TiAl alloy member 10 for hot forging is described. FIG. 2 is a flowchart illustrating a configuration of the method of manufacturing the TiAl alloy member 10 for hot forging. The method of manufacturing the TiAl alloy member 10 for hot forging includes a substrate formation step (S10) and an Al layer formation step (S12).

The substrate formation step (S10) is a step of forming the substrate 12 out of the TiAl alloy by melting and casting a TiAl alloy raw material. The TiAl alloy raw material is melted and casted in a vacuum induction melting furnace to form the substrate 12 formed of an ingot or the like. A casting apparatus used in casting of general metal materials can be used for the casting of the TiAl alloy raw material.

For example, when the substrate 12 is to be formed out of the high-speed forging TiAl alloy, an alloy having an alloy composition containing 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities can be used as the TiAl alloy raw material. Since the high-speed forging TiAl alloy has the aforementioned alloy composition, the high-speed forging TiAl alloy does not go through an $\alpha$ single phase region in a cooling process from melting temperature. When the alloy goes through the $\alpha$ single phase region, the ductility decreases due to coarsening of crystal grains. Since the casted high-speed forging TiAl alloy does not go through the $\alpha$ single phase region, the coarsening of crystal grains is suppressed.

Moreover, the casted high-speed forging TiAl alloy has a metallographic structure in which a crystal grain size is 200 μm or less, and borides with a particle size of 100 μm or less are contained. This boride is formed in a needle shape and is made of TiB, $TiB_2$, or the like. Since the casted high-speed forging TiAl alloy has a metallographic structure in which fine crystal grains with the crystal grain diameter of 200 μm or less, and borides with a particle size of 100 μm or less are contained as described above, the hot forging properties can be improved.

The substrate 12 may be formed by being subjected to HIP (hot isostatic pressing) processing after the casting. Subjecting the substrate 12 to HIP processing can suppress internal defects such as a casting defect. An HIP apparatus used in HIP processing of general metal materials can be used for HIP processing.

The Al layer formation step (S12) is a step of forming the Al layer 14, containing Al as the main constituent and containing Ti, on the surface of the substrate 12 by diffusion coating the substrate 12 with Al. The diffusion coating with Al (aluminization) can be performed by burying the substrate 12 in a processing powder obtained by mixing an Al raw material powder, an activator, and a sintering inhibitor and subjecting the substrate 12 to thermal treatment in a non-oxidizing atmosphere at 650° C. or higher and 800° C. or lower.

An Al powder such as a pure Al powder, an Al alloy powder, or the like may be used as the Al raw material powder. The main constituent of the Al alloy powder may be Al. In this case, the main constituent of the Al alloy powder is a constituent contained in the greatest amount in the Al alloy powder among the constituents contained in the Al alloy powder. When the Al powder is used as the Al raw material powder, the manufacturing cost can be reduced because the Al powder does not contain other alloy constituents. Meanwhile, when an Al—Cr alloy powder, an Al—Si alloy powder, or the like containing Cr or Si with excellent oxidation resistance is used, the oxidation resistance of the Al layer 14 can be improved. Note that a mixed powder of an Al powder and another additive element powder may be used as the Al raw material powder instead of the Al alloy powder. For example, when the Al layer 14 is to be formed by diffusion coating the substrate 12 with Al and Si, either an Al—Si alloy powder or a mixed powder of an Al powder and a Si powder may be used. Moreover, when the substrate 12 is made of the high-speed forging TiAl alloy, the Al raw material powder may contain no other alloy constituents and an Al powder such as a pure Al powder is used. This is because the adherence between the substrate 12 and the Al layer 14 in the case where an Al powder is used as the Al raw material powder is better than that in the case where an Al alloy powder such as an Al—Cr alloy powder is used as the Al raw material powder.

A halide such as a chloride and a fluoride may be used as the activator. For example, ammonium chloride ($NH_4Cl$) or the like can be used as the activator. An alumina ($Al_2O_3$) powder or the like can be used as the sintering inhibitor. Commercial products or the like can be used for an Al raw material powder, an activator, and a sintering inhibitor.

Next, the processing powder is prepared by mixing the Al raw material powder, the activator, and the sintering inhibitor. For example, the processing powder may contain 5 mass % or more and 40 mass % or less of Al raw material powder and 1 mass % or more and 5 mass % or less of activator with the balance being the sintering inhibitor. The ratio of the Al raw material powder may be 5 mass % or more and 20 mass % or less or may be 10 mass % or more and 20 mass % or less. Then, the processing powder is put into a ceramic container or the like and the substrate 12 is buried and packed in the processing powder.

The substrate 12 buried in the processing powder is subjected to thermal treatment in the non-oxidizing atmosphere. The thermal treatment causes the Al raw material powder and the activator to react and, for example, aluminum halide such as aluminum chloride is formed. Formed aluminum halide reacts with the substrate 12 and this causes Al to be deposited on the surface of the substrate 12 and form an Al deposited layer. Then, Ti diffuses out from the substrate 12 to the Al deposited layer and the Al layer 14 is formed. When an Al—Cr alloy powder, an Al—Si alloy powder, or the like is used as the Al raw material powder, Cr, Si, or the like can be deposited on the surface of the substrate 12 together with Al. Moreover, when the substrate 12 contains other alloy constituents in addition to Ti and Al, the other alloy constituents may diffuse out to the Al deposited layer and form the Al layer 14. For example, when the substrate 12 is made of the high-speed forging TiAl alloy, the Al layer 14 may contain at least one of constituents of Nb, V, and B diffused out from the substrate 12.

Thermal treatment temperature may be 650° C. or higher and 800° C. or lower. When the thermal treatment temperature is lower than 650° C., almost no aluminum halide is formed and the formation of the Al layer 14 is thus difficult. When the thermal treatment temperature is higher than 800° C., a large amount of aluminum halide is formed. Accordingly, the thickness of the Al layer 14 becomes large and the Al layer 14 is likely to peel off.

Thermal treatment time may be five minutes or longer and two hours or shorter. When the thermal treatment time is shorter than five minutes, almost no Al is deposited on the surface of the substrate 12 and the formation of the Al layer 14 is thus difficult. When the thermal treatment time is longer than two hours, a large amount of Al is deposited on the surface of the substrate 12. Accordingly, the thickness of the Al layer 14 becomes large and the Al layer 14 is likely to peel off.

A thermal treatment atmosphere may be a non-oxidizing atmosphere, for example, an inert atmosphere such as argon gas, a reducing atmosphere such as hydrogen gas, or a vacuum atmosphere to prevent oxidation and the like of the substrate and the Al raw material powder. A thermal treatment apparatus used in diffusion coating of general metal materials can be used as a diffusion coating apparatus. After the thermal treatment, the substrate 12 on which the Al layer 14 is formed is taken out from the processing powder and the powder or the like attaching thereto may be removed by using a brush or by performing ultrasonic cleaning or the like.

When the substrate 12 is made of the high-speed forging TiAl alloy, the high-speed forging TiAl alloy does not go through the α single phase region during the thermal treatment (including a temperature rise process and a cooling process in the thermal treatment) in the diffusion coating. Since the high-speed forging TiAl alloy does not go through the α single phase region during the thermal treatment in the diffusion coating, the coarsening of crystal grains can be suppressed.

After the Al layer formation step (S12), there may be performed an oxidizing step of oxidizing the substrate 12 on which the Al layer 14 is formed to form an alumina film on the surface of the Al layer 14. Forming the alumina film in advance before the hot forging in the air atmosphere can suppress the formation of α-case during the hot forging. A general atmospheric furnace or the like can be used for the oxidizing step. As a matter of course, the method may be such that no oxidation step as described above is provided and the alumina film is formed on the surface of the Al layer 14 by selectively oxidizing the Al layer 14 during temperature rise in the hot forging in the air atmosphere.

(Method of Forging TiAl Alloy Material 10 for Hot Forging)

Figure 3:
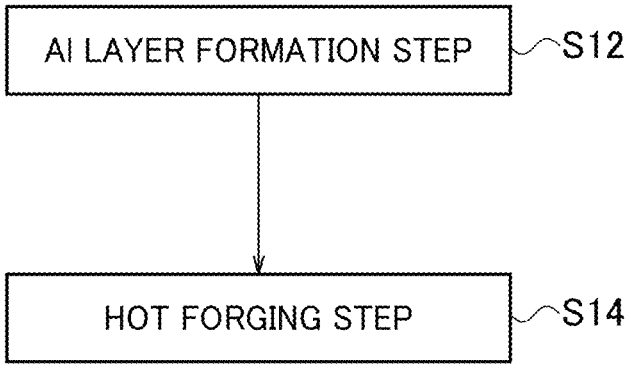
FIG. 3 is a flowchart illustrating a configuration of a method of forging the TiAl alloy member for hot forging in an embodiment of the present disclosure.

Next, a method of forging the TiAl alloy member 10 for hot forging is described. FIG. 3 is a flowchart illustrating a configuration of the method of forging the TiAl alloy member 10 for hot forging. The method of forging the TiAl alloy member 10 for hot forging includes the Al layer formation step (S12) and a hot forging step (S14). The Al layer formation step (S12) is a step of forming the Al layer 14, containing Al as the main constituent and containing Ti, on the surface of the substrate 12 by diffusion coating the substrate 12 made of TiAl alloy with Al. Since the Al layer formation step (S12) is the same as the Al layer formation step (S12) in the aforementioned method of manufacturing the TiAl alloy member 10 for hot forging, this step is denoted by the same reference numeral and detailed description thereof is omitted.

The hot forging step (S14) is a step of hot-forging the substrate 12 on which the Al layer 14 is formed in the air atmosphere. In the temperature rise process in the hot forging in the air atmosphere which is the oxidizing atmosphere, the Al layer 14 is selectively oxidized and the alumina film is formed on the surface of the Al layer 14. This alumina film serves as a protection oxide film and, in the hot forging in the air atmosphere, suppresses permeation of oxygen and prevents the formation of α-case. Since the formation of α-case is prevented in the hot forging, a forging crack can be suppressed.

Moreover, since the formation of α-case is prevented in the hot forging, the strain rate in the hot forging can be increased. Specifically, when the α-case is formed, a crack is likely to be formed from the α-case. Accordingly, a forging crack is likely to be formed in the TiAl alloy and it is difficult to increase the strain rate in the hot forging. Meanwhile, when the formation of α-case can be suppressed, the strain rate in the hot forging can be increased. Thus, high-speed forging can be performed.

In the aforementioned high-speed forging TiAl alloy containing 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities, when the α-case is formed in the hot forging, there is a possibility that a forging crack is formed. Accordingly, it is difficult to perform high-speed forging at a strain rate of 1/second or higher or at a strain rate of 10/second or higher. Meanwhile, when the formation of α-case is suppressed in the hot forging, the high-speed forging at a strain rate of 1/second or higher or at a strain rate of 10/second or higher can be performed.

The heating temperature in the hot forging may be 1200° C. or higher and 1350° C. or lower. For example, when the high-speed forging TiAl alloy is heated to temperature of 1200° C. or higher and 1350° C. or lower, the high-speed forging TiAl alloy is holded in a two-phase region of α phase+β phase or a three-phase region of α phase+β phase+γ phase. Since the heated high-speed forging TiAl alloy contains β phase with excellent high-temperature deformation properties, the high-speed forging TiAl alloy can be easily deformed. Moreover, the high-speed forging TiAl alloy does not go through the α single phase region in the temperature rise from room temperature to the heating temperature of 1200° C. or higher and 1350° C. or lower. Accordingly, the coarsening of crystal grains is suppressed. This suppresses a decrease in ductility and the forging properties can be further improved.

A forging apparatus and a forging method for general metal materials such as free forging, die forging, roll forging, extruding, or the like can be used for the hot forging method. The alumina film and the Al layer 14 remaining after the hot forging can be easily removed by machining, polishing, or the like.

Note that the TiAl alloy member 10 for hot forging can be used as a forging material when parts such as a turbine blade which is an aircraft engine part are formed by the hot forging in the air atmosphere. Moreover, when the high-speed forging TiAl alloy is used for the substrate 12 of the TiAl alloy member 10 for hot forging, the high-speed forging at a strain rate of 1/second or higher or at a strain rate of 10/second or higher can be performed. Thus, productivity of parts such as turbine blades can be improved.

As described above, in the embodiment, the substrate made of TiAl alloy is diffusion coated with Al and then hot-forged in the air atmosphere. This can prevent the formation of α-case and suppress the forging crack. Accordingly, there is no need to perform difficult welding work and the like performed in a conventional technique when the TiAl alloy is coated with a sheath of Ti, a Ti alloy, or the like having deformation resistance similar to the TiAl alloy. Thus, workability in hot forging can be improved. Moreover, when the TiAl alloy is coated with the sheath of Ti, the Ti alloy, or the like and is hot-forged, the sheath firmly adheres to the TiAl alloy after the hot forging and work of removing the sheath becomes difficult in some cases. However, in the aforementioned configuration, the alumina film and the Al layer remaining after the hot forging can be easily removed by machining, polishing, or the like. Accordingly, the workability in hot forging is improved. Moreover, in the aforementioned configuration, since the diffusion coating with Al is performed by using the low-cost Al raw material powder, the manufacturing cost can be reduced from that in the case of using the sheath of Ti, the Ti alloy, or the like which is high in cost.

In the embodiment, it is possible to prevent the formation of α case in the hot forging in the air atmosphere and to suppress the forging crack. Accordingly, the hot forging can be performed at a higher strain rate. For example, in conventional isothermal forging of TiAl alloy, hot forging is performed at a low strain rate (for example, $5\times10^{-5}$/second to $5\times10^{-1}$/second). Meanwhile, the aforementioned high-speed forging TiAl alloy can be subjected to high-speed forging at a strain rate of 1/second or higher or at a strain rate of 10/second or higher. Accordingly, the productivity of parts such as turbine blades can be improved.

Example (Casting of TiAl Alloy)

A TiAl alloy raw material was melted and casted in a high-frequency vacuum melting furnace to form a substrate. A material with an alloy composition containing 43 at % of Al, 4 at % of Nb, 5 at % of V, and 0.2 at % of B with the balance being Ti and unavoidable impurities was used as the TiAl alloy raw material. The substrate was thus formed out of the high-speed forging TiAl alloy.

(Evaluation of Substrate in Terms of Ductility in Hot Forging)

The casted substrate was evaluated in terms of the ductility in hot forging to evaluate effects of α-case on the hot forging. Specifically, reduction of area in the substrate was measured by performing tensile test using a Gleeble tester. The test temperature was 1250° C. to 1275° C. The reduction of area was calculated by measuring a cross section reduction ratio of a broken portion of a broken material. The test atmospheres were an inert atmosphere of argon gas and the air atmosphere. The strain rates in the inert atmosphere were 1/second, 2/second, and 10/second. The strain rates in the air atmosphere were 0.2/second, 1/second, and 5/second.

Figure 4:
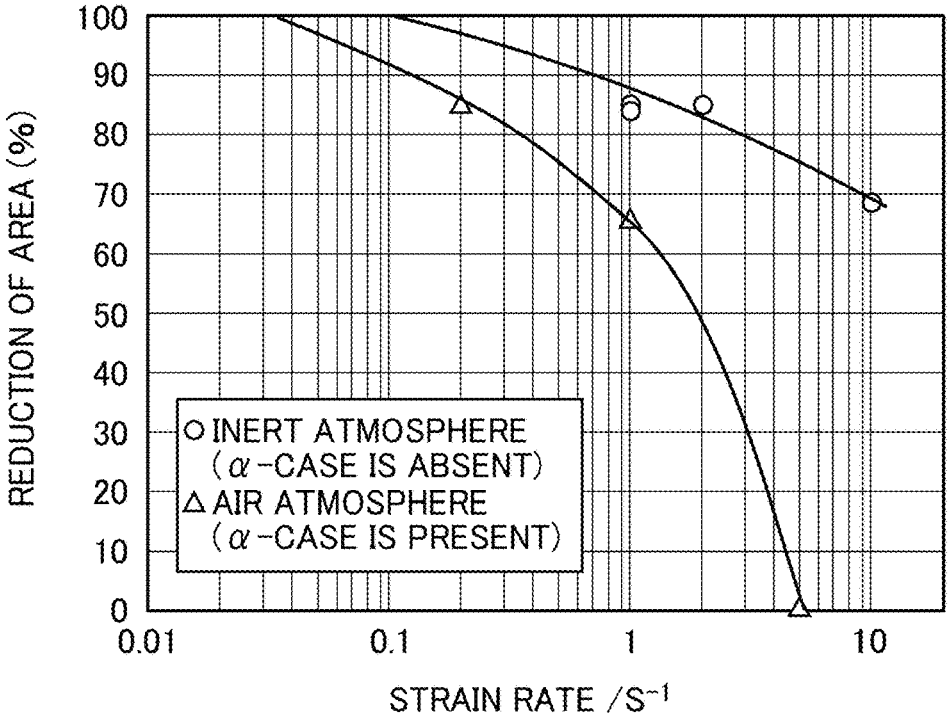
FIG. 4 is a graph illustrating measurement results of the reduction of area in a substrate in the embodiment of the present disclosure.

FIG. 4 is a graph illustrating measurement results of the reduction of area in the substrate. In the graph of FIG. 4, the horizontal axis represents the strain rate, the vertical axis represents the reduction of area, white circles represent the reduction of area in the inert atmosphere, and white triangles represent the reduction of area in the air atmosphere. The reduction of area in the substrate tested in the inert atmosphere was greater than that in the substrate tested in the air atmosphere. In the test in the air atmosphere, the reduction of area reached substantially 0% at the strain rate of 5/second and brittle fracture occurred. Meanwhile, in the test in the inert atmosphere, the reduction of area was about 70% even at the strain rate of 10/second.

Figure 5:
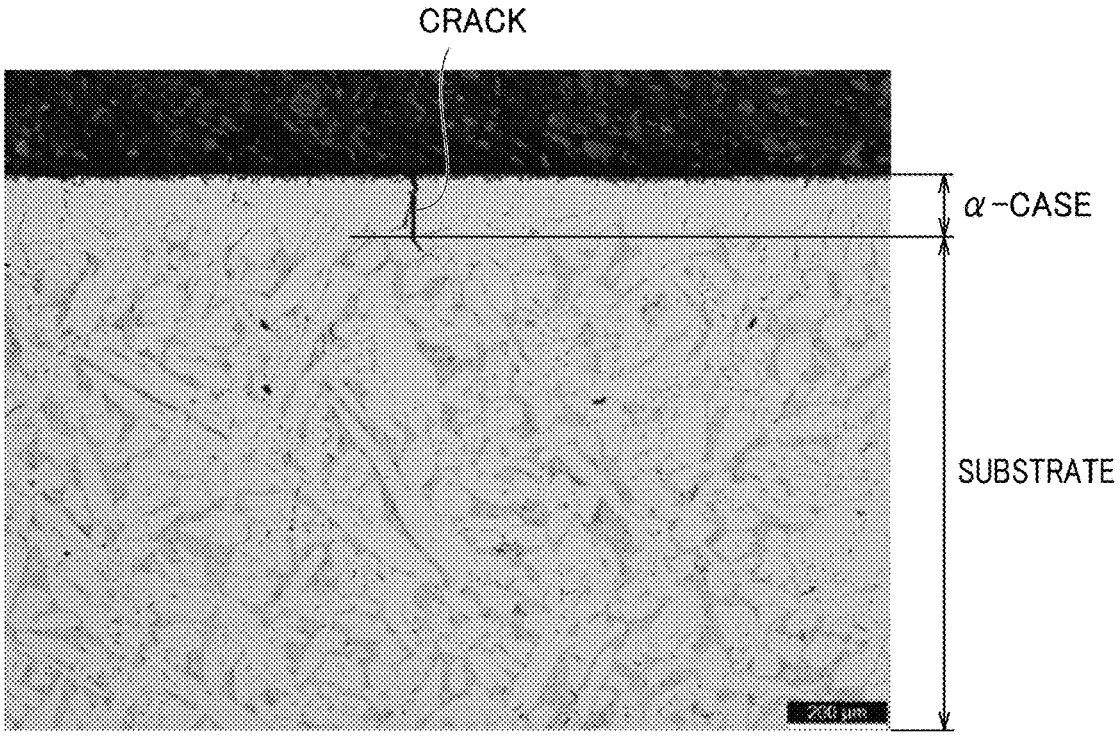
FIG. 5 is a photograph showing an observation result of the metallographic structure of the substrate tested in an air atmosphere in the embodiment of the present disclosure.

It is assumed that this was because no α-case was formed in the substrate tested in the inert atmosphere while the α-case was formed in the substrate tested in the air atmosphere. FIG. 5 is a photograph showing an observation result of the metallographic structure of the substrate tested in the air atmosphere. In the substrate tested in the air atmosphere, the α-case was formed and crack was observed in the α-case. Meanwhile, no formation of α-case was recognized in the substrate tested in the inert atmosphere.

From this result, it was found that, when the α-case is formed, plastic deformation of TiAl alloy becomes difficult and the forging crack is likely to occur in the hot forging of TiAl alloy. Moreover, it was found that, when the α-case is formed, the high-speed forging TiAl alloy hardly plastically deforms at a strain rate higher than 1/second and hot forging at high speed is thus impossible.

(Evaluation in Terms of Suppression of α-Case)

Specimens of Example 1 and Comparative Examples 1 to 7 were evaluated in terms of suppression of α-case. First, methods of fabricating the specimens are described. The aforementioned casted substrate was used as substrates of the respective specimens.

In the specimen in Example 1, the substrate was diffusion coated with Al to form the Al layer on the surface of the substrate. A processing powder obtained by mixing a pure Al powder, an ammonium chloride ($NH_4Cl$) powder, and an alumina powder was used in the diffusion coating. The ratio of the pure Al powder in the processing powder was 20 mass %. The processing powder was put into a ceramic container and the substrate was buried in the processing powder and subjected to thermal treatment in an inert atmosphere of argon gas. The thermal treatment conditions were such that the thermal treatment temperature was 650° C. to 800° C. and the thermal treatment time was five minutes to two hours. The Al layer was analyzed by energy dispersive X-ray analysis (EDX) after the diffusion coating and the Al concentration in the Al layer was 70 at % or more. From this result, it was found that the main constituent of the Al layer was Al. Moreover, it was found that, since the Al layer contained Ti, Ti diffused out from the substrate and was contained in the Al layer.

In the specimen in Comparative Example 1, the substrate without coating (substrate as it was) was used. In the specimens of Comparative Examples 2 to 4, ceramic coating obtained by mixing a ceramic powder, a binder, and a solvent was applied onto the surface of the substrate and was fired at 350° C. or higher to form a ceramic film. In the specimen in Comparative Example 2, a ceramic powder containing alumina ($Al_2O_3$) and silica ($SiO_2$) as the main constituent was used. In the specimen in Comparative Example 3, a ceramic powder containing alumina ($Al_2O_3$) as the main constituent was used. In the specimen in Comparative Example 4, a ceramic powder containing zirconia ($Zr_2O$) as the main constituent was used.

In the specimens of Comparative Examples 5 to 7, a titanium-based ceramic film was formed on the surface of the substrate by sputtering. The titanium-based ceramic film in the specimen in Comparative Example 5 was titanium nitride (TiN). The titanium-based ceramic film in the specimen in Comparative Example 6 was titanium aluminum nitride (TiAlN). The titanium-based ceramic film in the specimen in Comparative Example 7 was formed of two layers of titanium (Ti) and titanium aluminum nitride (TiAlN). The film thickness of the titanium-based ceramic film in each specimen was about 5 μm.

Next, each specimen was subjected to thermal treatment in the air atmosphere and was evaluated in terms of the formation of α-case. The thermal treatment temperature was 1250° C. to 1275° C. A metallographic structure in a cross section of the specimen was observed with an optical microscope after the thermal treatment to perform the evaluation for the α-case. Table 1 depicts evaluation results of α-case suppression in the respective specimens.

TABLE 1

| | Coating method | Coating material | α-case after thermal treatment |
|---|---|---|---|
| Example 1 | Al diffusion coating (aluminization) | Al layer | Absent |
| Comparative Example 1 | Not performed | — | Present |
| Comparative Example 2 | Ceramic coating | $Al_2O_3$, $SiO_2$ | Present |
| Comparative Example 3 | Ceramic coating | $Al_2O_3$ | Present |
| Comparative Example 4 | Ceramic coating | $Zr_2O$ | Present |
| Comparative Example 5 | Sputtering | TiN | Present |
| Comparative Example 6 | Sputtering | TiAlN | Present |
| Comparative Example 7 | Sputtering | Ti + TiAlN | Present |

Figure 6A:
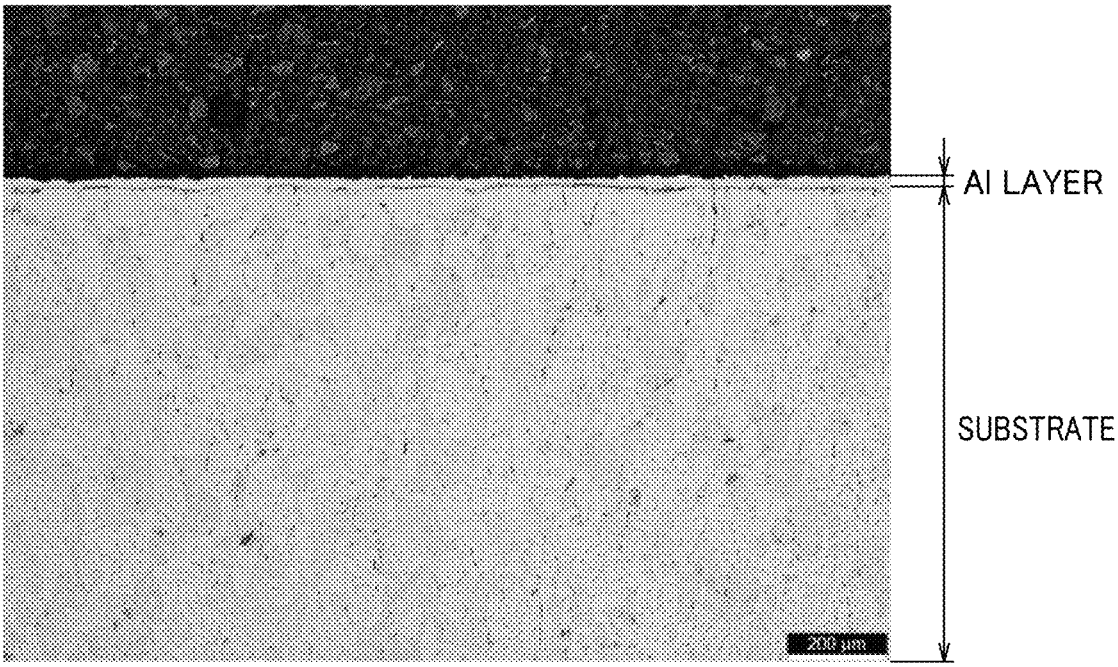
FIG. 6A is a photograph showing observation result of the metallographic structure of specimen in Example 1 in the embodiment of the present disclosure.
Figure 6B:
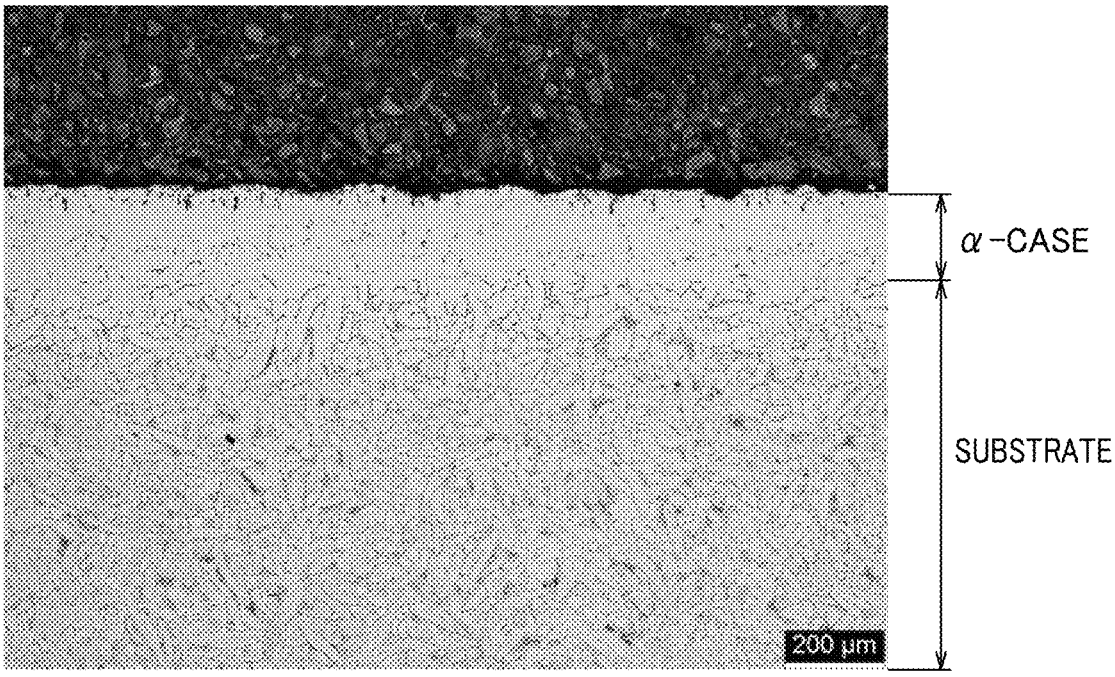
FIG. 6B is a photograph showing observation result of the metallographic structure of specimen in Comparative Example 1 in the embodiment of the present disclosure.

FIG. 6A and FIG. 6B are photographs showing observation results of the metallographic structures of the specimens in Example 1 and Comparative Example 1. FIG. 6A is a photograph of the specimen in Example 1. FIG. 6B is a photograph of the specimen in Comparative Example 1. In the specimen in Example 1, the Al layer was formed on the surface of the substrate and no formation of α-case was recognized. The thickness of the Al layer was 50 μm to 100 μm. Meanwhile, in the specimen in Comparative Example 1, the formation of α-case was recognized.

Figure 7A:
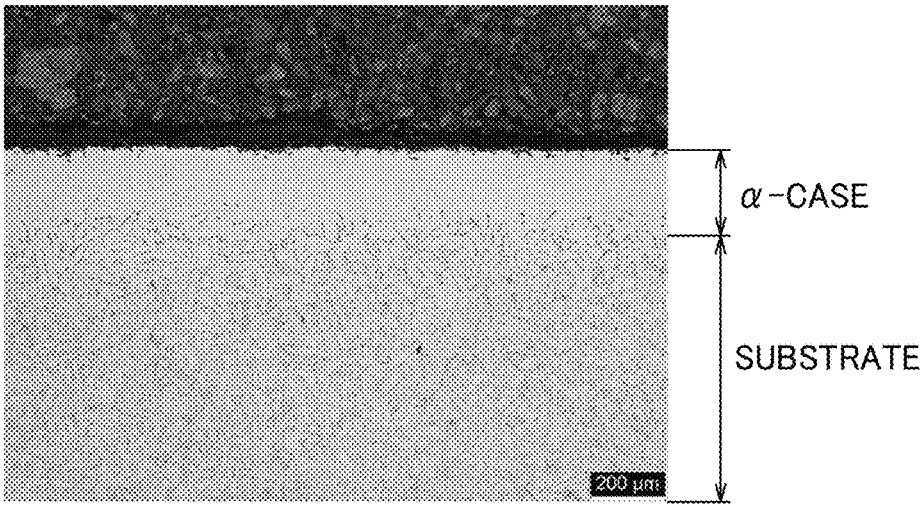
FIG. 7A is a photograph showing observation result of the metallographic structure of specimen in Comparative Example 2 in the embodiment of the present disclosure.
Figure 7B:
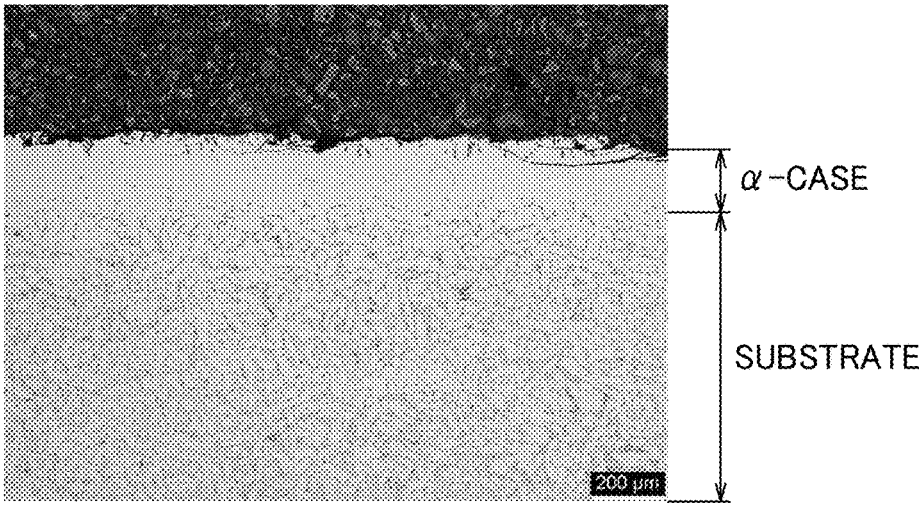
FIG. 7B is a photograph showing observation result of the metallographic structure of specimen in Comparative Example 3 in the embodiment of the present disclosure.
Figure 7C:
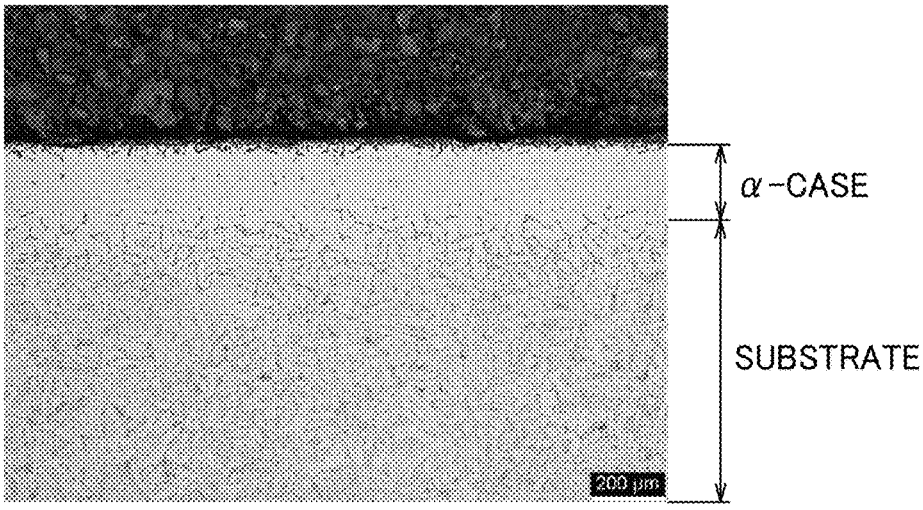
FIG. 7C is a photograph showing observation result of the metallographic structure of specimen in Comparative Example 4 in the embodiment of the present disclosure.

FIG. 7A, FIG. 7B and FIG. 7C are photographs showing observation results of the metallographic structures of the specimens in Comparative Examples 2 to 4. FIG. 7A is a photograph of the specimen in Comparative Example 2. FIG. 7B is a photograph of the specimen in Comparative Example 3. FIG. 7C is a photograph of the specimen in Comparative Example 4. In the specimens in Comparative Examples 2 to 4, the formation of α-case was recognized. The reason for this is assumed to be as follows. The ceramic film formed by the ceramic coating was not dense. Thus, oxygen permeated through the ceramic film and the α-case was formed.

Figure 8A:
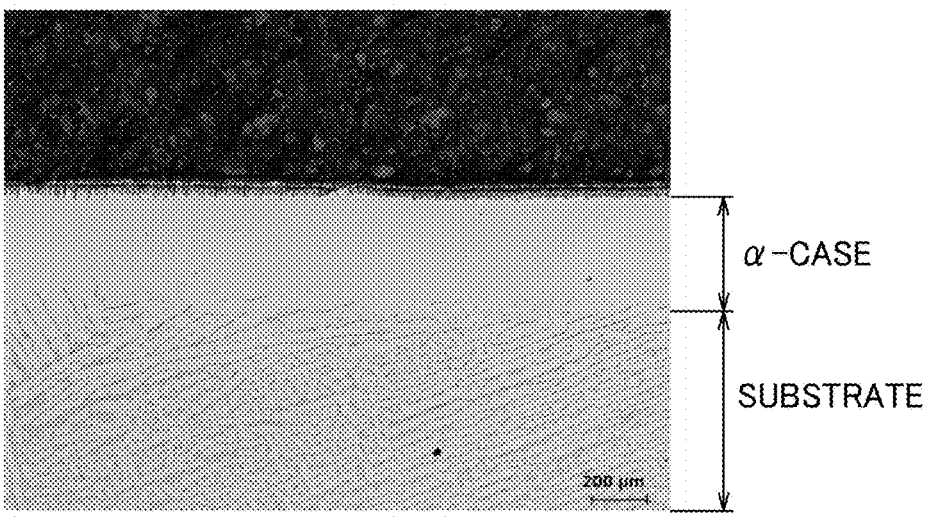
FIG. 8A is a photograph showing observation result of the metallographic structure of the specimen in Comparative Example 5 in the embodiment of the present disclosure.
Figure 8B:
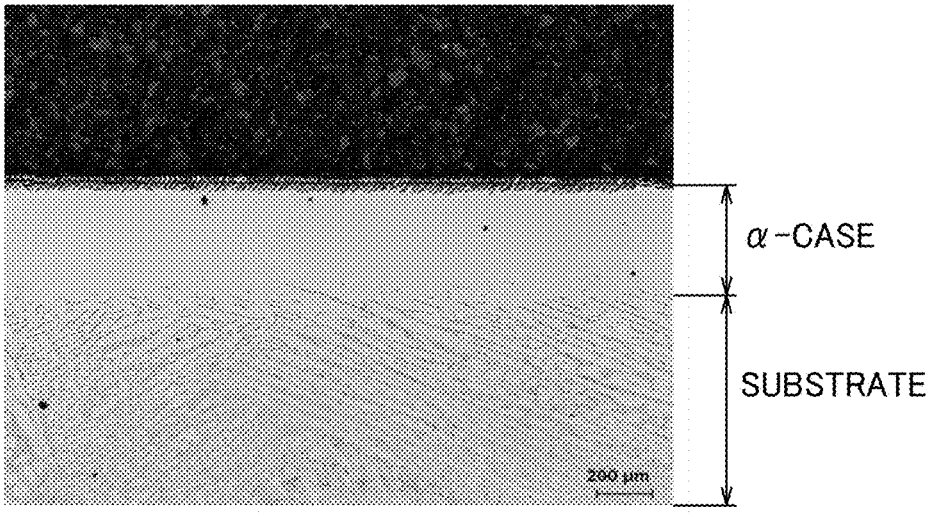
FIG. 8B is a photograph showing observation result of the metallographic structure of the specimen in Comparative Example 6 in the embodiment of the present disclosure.
Figure 8C:
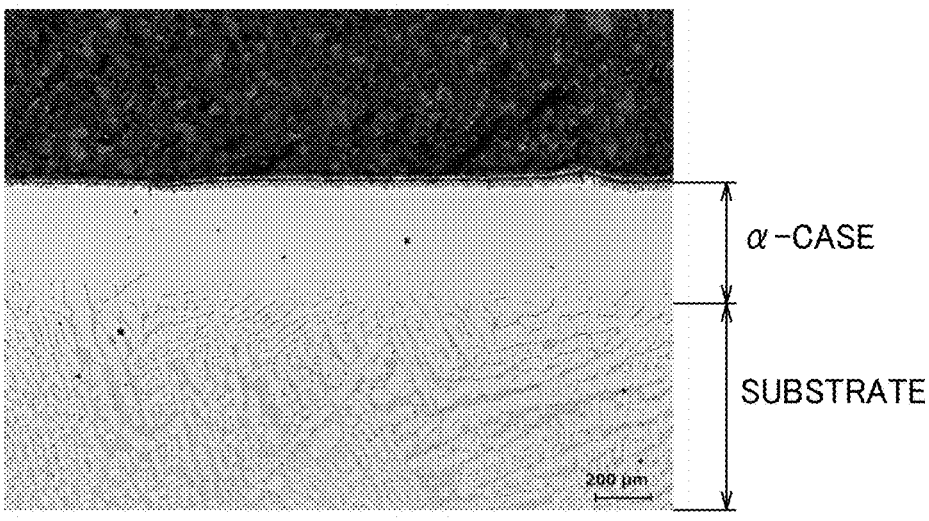
FIG. 8C is a photograph showing observation result of the metallographic structure of the specimen in Comparative Example 7 in the embodiment of the present disclosure.

FIG. 8A, FIG. 8B and FIG. 8C are photographs showing observation results of the metallographic structures of the specimens in Comparative Examples 5 to 7. FIG. 8A is a photograph of the specimen in Comparative Example 5. FIG. 8B is a photograph of the specimen in Comparative Example 6. FIG. 8C is a photograph of the specimen in Comparative Example 7. In the specimens of Comparative Examples 5 to 7, the formation of α-case was recognized. The reason for this is assumed to be as follows. The titanium-based ceramic film formed by sputtering was a thin film. Thus, oxygen permeated through the titanium-based ceramic film and the α-case was formed.

From these results, it was found that diffusion coating the substrate with Al and forming the Al layer on the surface of the substrate can suppress the formation of α-case even when the substrate is thermally exposed in the air atmosphere.

(Evaluation of Substrate on which Al Layer was Formed in Terms of Ductility in Hot Forging)

The substrate on which the Al layer was formed was evaluated in terms of ductility in hot forging. First, methods of fabricating specimens of Example 2 and Comparative Example are described. The aforementioned casted substrate subjected to the HIP processing was used as the substrate of each specimen. As the specimen in Example 2, the substrate subjected to the HIP processing was diffusion coated with Al to form the Al layer on the surface of the substrate subjected to the HIP processing. The diffusion coating with Al was performed in the same method as that for the specimen in Example 1. The specimen in Comparative Example 8 was the substrate subjected to the HIP processing without coating (substrate subjected to the HIP processing as it was).

The reduction of area in each of the specimens of Example 2 and Comparative Example 8 was measured. The reduction of area was measured by performing tensile test using the Gleeble tester as in the aforementioned evaluation of the substrate in terms of the ductility in hot forging. The test temperature was 1250° C. to 1275° C. The test atmosphere was the air atmosphere. The strain rates were 1/second, 5/second, 7/second, and 10/second.

Figure 9:
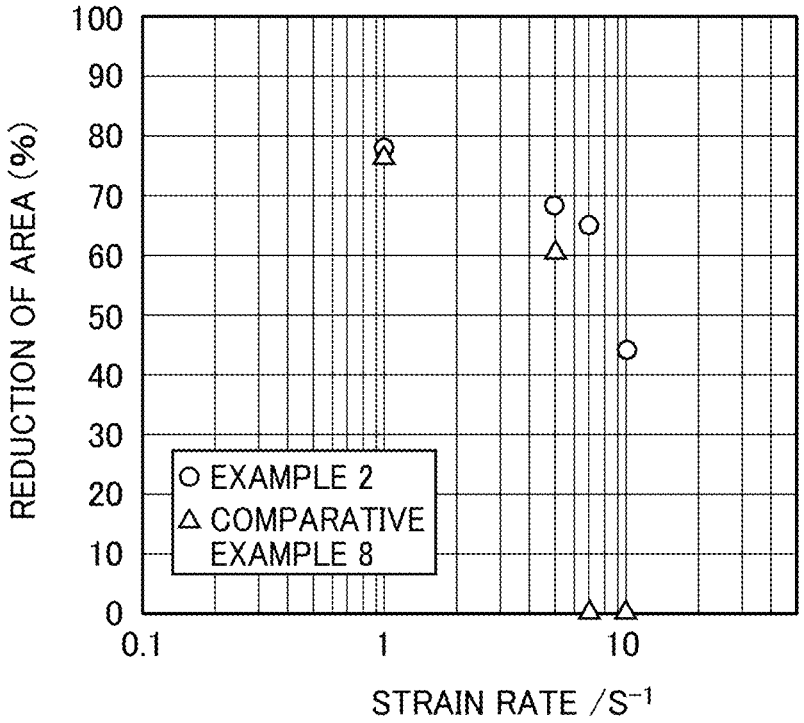
FIG. 9 is a graph illustrating measurement results of the reduction of area in each specimen in the embodiment of the present disclosure.

FIG. 9 is a graph illustrating measurement results of the reduction of area in each specimen. In the graph of FIG. 9, the horizontal axis represents the strain rate, the vertical axis represents the reduction of area, white circles represent the reduction of area in the specimen in Example 2, and white triangles represent the reduction of area in the specimen in Comparative Example 8. The reduction of area in the specimen in Example 2 was greater than that in the specimen in Comparative Example 8. Specifically, the reduction of area in the specimen in Example 2 was greater than that in the specimen in Comparative Example 8 when the strain rate was 1/second or higher, 5/second or higher, and 10/second or higher.

In the specimen in Comparative Example 8, the reduction of area reached substantially 0% at the strain rate of 7/second or higher and brittle fracture occurred. Meanwhile, in the specimen in Example 2, the reduction of area was about 60% to 70% at the strain rate of 7/second and was about 40% to 50% at the strain rate of 10/second. Each specimen was evaluated in terms of presence or absence of α-case after the test. The formation of α-case was recognized in the specimen in Comparative Example 8 while no formation of α-case was recognized in the specimen in Example 2. As described above, it was found that the specimen in Example 2 had excellent ductility in the hot forging in the air atmosphere.

(Hot Forging Test)

Figure 10A:
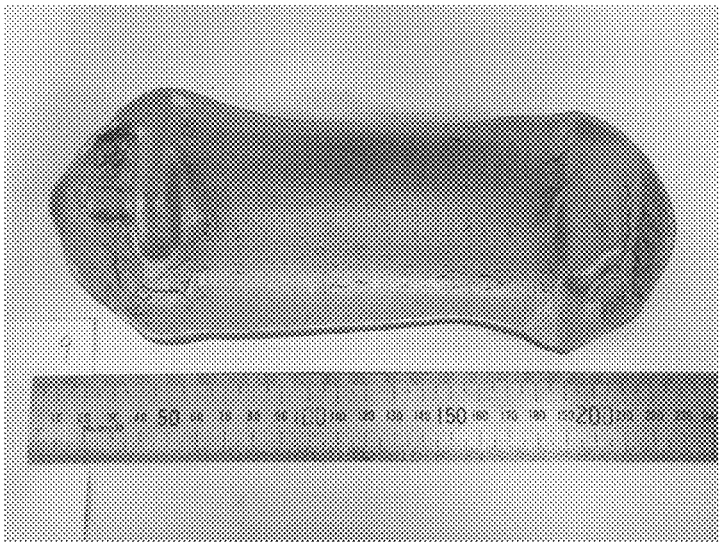
FIG. 10A is a photograph showing observation result of appearance of the upper die side after a hot forging test in the embodiment of the present disclosure.
Figure 10B:
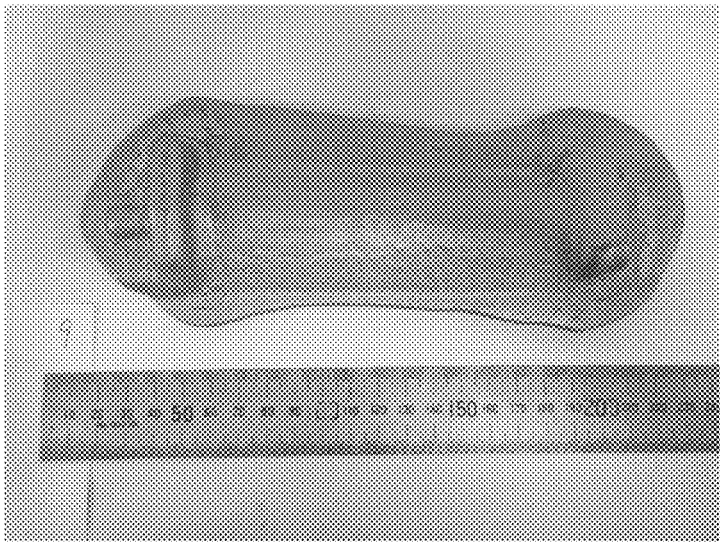
FIG. 10B is a photograph showing observation result of appearance of the lower die side after a hot forging test in the embodiment of the present disclosure.

Hot forging test was performed for the specimen in Example 2. In the hot forming test, the specimen was subjected to press die forging at the strain rate of 10/second while being holded in a two-phase region of α phase+β phase at 1250° C. to 1275° C. in the air atmosphere. FIG. 10A and FIG. 10B are photographs showing observation results of appearance after the hot forging test. FIG. 10A is a photograph showing the upper die side. FIG. 10B is a photograph showing the lower die side. As shown in FIG. 10A and FIG. 10B, there was no forging crack in the specimen after the hot forging and it was found that hot forging at high speed is possible.

Since the present disclosure can more easily prevent the formation of α-case in the hot forging in the air atmosphere and suppress the forging crack, the present disclosure is useful in parts such as a turbine blade which is an aircraft engine part.

What is claimed is:

1. A method of manufacturing a TiAl alloy member for hot forging, comprising:

forming a substrate by melting and casting a TiAl alloy raw material; and forming an Al layer, containing 70 at % or more of Al and containing Ti, directly on a surface of the substrate by diffusion coating the substrate with Al, wherein the forming the Al layer comprises burying the substrate in a processing powder obtained by mixing an Al raw material powder, an activator, and a sintering inhibitor and is subjected to thermal treatment in a non-oxidizing atmosphere at 650° C. or higher and 800° C. or lower.

2. The method of manufacturing a TiAl alloy member according to claim 1, wherein the TiAl alloy raw material contains 41 at % or more and 44 at % or less of Al, 4 at % or more and 6 at % or less of Nb, 4 at % or more and 6 at % or less of V, and 0.1 at % or more and 1 at % or less of B with the balance being Ti and unavoidable impurities.

3. The method of manufacturing a TiAl alloy member according to claim 1, further comprising oxidizing the substrate on which the Al layer is formed to yield an alumina film on the surface of the Al layer after forming the Al layer.

4. The method of manufacturing a TiAl alloy member according to claim 1, wherein the Al layer is from 10 μm to 100 μm thick.

* * * * *